US007771086B2

(12) United States Patent
Goverde

(10) Patent No.: US 7,771,086 B2
(45) Date of Patent: Aug. 10, 2010

(54) LIGHTING DEVICE COMPRISING A LAMP UNIT A REFLECTOR

(75) Inventor: Godefridus Cornelis Goverde, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 280 days.

(21) Appl. No.: 11/572,584

(22) PCT Filed: Jul. 19, 2005

(86) PCT No.: PCT/IB2005/052396

§ 371 (c)(1),
(2), (4) Date: Jan. 24, 2007

(87) PCT Pub. No.: WO2006/013495

PCT Pub. Date: Feb. 9, 2006

(65) Prior Publication Data

US 2008/0055910 A1 Mar. 6, 2008

(30) Foreign Application Priority Data

Jul. 27, 2004 (EP) ..... 04103594

(51) Int. Cl.
*F21V 29/00* (2006.01)

(52) U.S. Cl. ..... 362/294; 362/373

(58) Field of Classification Search ..... 362/294, 362/373, 341, 345, 347, 416, 430, 444, 457, 362/458

See application file for complete search history.

(56) References Cited

U.S. PATENT DOCUMENTS

| | | | | |
|---|---|---|---|---|
| 429,390 | A | 6/1890 | Shaphard et al. | |
| 3,703,635 | A | 11/1972 | Burkarth | |
| 3,827,782 | A | 8/1974 | Boudouris et al. | |
| 4,855,884 | A | 8/1989 | Richardson | |
| 6,974,234 | B2 * | 12/2005 | Galli | 362/294 |
| 2003/0021120 | A1 * | 1/2003 | Teichgraeber et al. | 362/294 |
| 2005/0122724 | A1 * | 6/2005 | Hirata et al. | 362/345 |

FOREIGN PATENT DOCUMENTS

| | | | |
|---|---|---|---|
| DE | 10100724 | A1 | 11/2002 |
| EP | 0870979 | A2 | 10/1998 |
| EP | 0870979 | B1 | 10/1998 |
| EP | 0902231 | A2 | 3/1999 |
| EP | 0902231 | B1 | 3/1999 |
| EP | 1164328 | A2 | 12/2001 |
| EP | 1312967 | A1 | 5/2003 |
| GB | 429390 | A | 5/1935 |
| JP | 04363804 | A | 12/1992 |
| JP | 2002184234 | A | 6/2002 |
| WO | 0248609 | A1 | 6/2002 |

* cited by examiner

*Primary Examiner*—Anabel M Ton

(57) ABSTRACT

A lighting device (1) comprises a lamp unit (10) for emitting light, a reflector (20) for reflecting the emitted light, and a housing (30) for accommodating both the lamp unit (10) and the reflector (20). Much heat is generated by the lamp unit (10) during operation of the device (1) if the lamp unit (10) comprises a lamp operating at a high power level, such as an ultra high performance lamp, which heat needs to be dissipated to the environment of the lighting device (1). For this purpose, the lighting device (1) is provided with a heat sink (40) arranged between the reflector (20) and the housing (30), which heat sink is thermally coupled to both the reflector (20) and the housing (30). The heat sink (40) comprises metal strips (42) which surround the reflector (20).

9 Claims, 4 Drawing Sheets

LIGHTING DEVICE COMPRISING A LAMP UNIT A REFLECTOR

The present invention relates to a lighting device, comprising: a lamp unit for emitting light; a reflector for reflecting light emitted by the lamp unit, substantially shaped like a bowl having a hole in its bottom for allowing the lamp unit to pass through; and a housing for accommodating both the lamp unit and the reflector.

European patent application 1 164 328 discloses a lighting device comprising a lamp unit for emitting light and a reflector for reflecting light emitted by the lamp unit, substantially shaped like a bowl having a hole in its bottom for allowing the lamp unit to pass through. The lamp unit is attached to the reflector, and the assembly of the lamp and the reflector is arranged inside a housing that comprises a transmission window for transmitting the light originating from the lamp-reflector assembly, the reflector being fixed to the housing.

An important function of the housing is to prevent scattered matter that may be generated when the lighting device breaks down from leaving the device. In this way, the security of the lighting device is improved with respect to lighting devices without a housing. The measures taken for the purpose of keeping scattered matter inside the device are particularly relevant if the lamp comprises mercury or other hazardous materials. If the lamp comprises mercury, the housing also plays a role in preventing an escape of mercury vapor from the lighting device.

In many applications, the lamp is a high-power lamp, and it is important that measures are taken for preventing the temperature of the lamp from getting above a predetermined maximum. EP 1 164 328 discloses a number of examples of such measures. In one embodiment, a heat sink is provided, which is attached and thermally coupled to the lamp. The heat sink is, for example, a radiation fin that serves to suppress the temperature increase of the lamp by enlarging the surface area. In another embodiment, a convection apparatus for cooling is provided in the housing. This apparatus is, for example, a cooling fan for forcefully causing a convection of the air in the inside of the housing.

It is an object of the present invention to provide a lighting device having a lamp unit and a reflector which are arranged in a housing, wherein measures are taken for ensuring that heat is dissipated to a sufficient extent during operation of the lighting device. The objective is achieved by a lighting device, comprising: a lamp unit for emitting light; a reflector for reflecting light emitted by the lamp unit, substantially shaped like a bowl having a hole in its bottom for allowing the lamp unit to pass through; a housing for accommodating both the lamp unit and the reflector; and a heat sink arranged between the reflector and the housing for transferring heat from the reflector to the housing during operation of the lighting device, which heat sink is thermally coupled to both the reflector and the housing.

According to the present invention, a heat sink is provided, which serves for transferring heat from the reflector to the housing during operation of the lighting device. In order to be able to perform this function properly, the heat sink is arranged between the reflector and the housing, while being thermally coupled to both the reflector and the housing.

It may be true that EP 1 164 328 also discloses the use of a heat sink for dissipating heat, but this heat sink is attached to the lamp and performs its function mainly on the basis of an enlargement of the surface area. The heat sink according to the present invention is arranged between the reflector and the housing, and is thermally coupled to both the reflector and the housing. In this way, the heat sink is capable of conducting heat from the reflector to the housing, whereupon the housing emits the heat to the environment. The heat sink according to the present invention can be far more effective than the heat sink known from EP 1 164 328, as it may be designed such that it contacts a considerable portion of the relatively large surface of the reflector. Therefore, when the heat sink according to the invention is applied, it is even possible to downsize the lighting device. Moreover, the heat sink hardly occupies any space, as it may be formed as just a thin layer between the reflector and the housing. For example, the heat sink may comprise thin strips surrounding the reflector, which strips are preferably made of a heat-conducting metal such as copper. Preferably, the heat sink comprises resilient elements, so that it is ensured that a good contact is obtained between the heat sink and both the reflector and the housing.

It is another object of the present invention to provide a simple arrangement for connecting the lamp unit to the housing of the lighting device, especially if the lamp unit comprises a so-called ultra high performance lamp (UHP-lamp), which comprises a lamp bulb and two rod-shaped connection arms extending on opposite sides of the lamp bulb. According to the present invention, a base plate that is connected to the housing is provided for the purpose of connecting an end of one of the connection arms to the housing, the end of the connection arm being connected to said base plate.

In a preferred embodiment, the base plate comprises at least one hole for allowing the end of the connection arm that is connected to the base plate to cool down by allowing heat that is emitted by this end to pass through the hole.

In another preferred embodiment, the connection between the end of the connection arm and the base plate is established through an engagement of the end of the connection arm with at least one connection piece that is partly cut out and bent from the base plate. An advantage of this embodiment is that the base plate is provided with at least one hole, which has a cooling effect, as has already been noted. Furthermore, it is not necessary to apply a separate connection piece for connecting the lamp unit to the base plate, as the connection piece is an integral part of the base plate. For example, the end of the connection arm of the lamp unit is clamped between three connection pieces which are formed as pieces that are partly cut out from the base plate and bent in an upward direction with respect to the base plate.

Additional measures may be taken for the purpose of ensuring a tight connection between the end of the connection arm and the at least one connection piece of the base plate, such as pulling a wire around the end of the connection arm and the connection piece, or using cement. Furthermore, the end of the connection arm may be provided with a groove, and the connection piece may comprise a portion that can be snapped into the groove.

It is yet another object of the present invention to facilitate positioning of the reflector in the housing. This object is achieved by a lighting device in which the reflector is clamped in by the housing, and in which the shape of a circumference of the housing is different from the shape of a circumference of the reflector. Due to the fact that the circumferences of the housing and the reflector have different shapes, room is left for adjustment of the position of the reflector inside the housing. This advantageous aspect is not present in the case in which the shape of the circumference of the housing is similar to the shape of the circumference of the reflector.

In an advantageous embodiment, the circumference of the reflector has a round shape, and elements of the housing intended to exert a clamping force on the reflector are provided in a triangular arrangement. In this embodiment, three areas of the reflector are subjected to clamping forces by the housing, which areas are evenly distributed over the circumference of the reflector. An optimal fixation of the reflector in the housing is thus obtained. An additional advantage is that triangular constructions are known to be very robust.

Preferably, the elements of the housing intended to exert a clamping force on the reflector are resilient. The clamping action of the housing is enhanced thereby, and it is possible to compensate for differences between predetermined standard dimensions of the reflector and actual dimensions of the reflector.

It is yet another object of the present invention to provide a simple arrangement for connecting the reflector to the housing of the lighting device, and avoiding the use of separate connecting elements such as clamping rings. According to the present invention, the reflector is fixed with respect to the housing by means of at least one projection held by an engaging member engaging the projection, wherein the at least one projection extends from one of the reflector and the housing, and wherein the engaging member is arranged on the respective other one of the reflector and the housing.

For example, a number of projections are arranged on the reflector, and the housing comprises a row of saw teeth. In this arrangement, the reflector is connected to the housing by insertion of the reflector in the housing and rotation of the reflector about its longitudinal axis until a tight engagement between the projections on the reflector and the points of the saw teeth on the housing is obtained. According to another feasible possibility, leaf springs are provided on the housing, and a tight engagement is obtained when the projections on the reflector are put into contact with the leaf springs, the leaf springs being compressed thereby. It will be understood that any element that is inclined to spring outwards when it is compressed is suitable for use as an engaging member.

The present invention will now be explained in greater detail with reference to the Figures, in which similar parts are indicated by the same reference signs, and in which.

Figure 11:
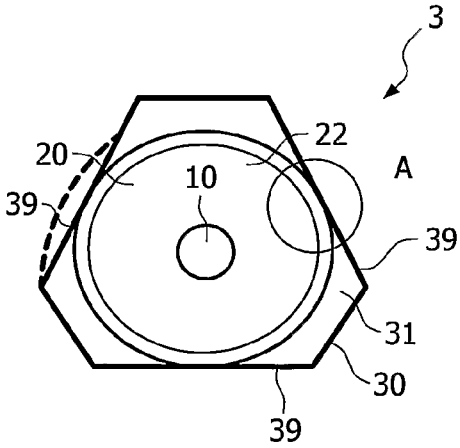
FIG. 11 is a diagrammatic front elevation of a lighting device according to a third preferred embodiment of the present invention.
Figure 14:
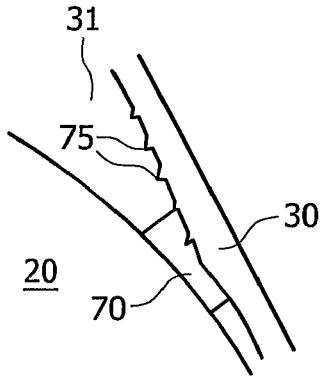
Figure 15:
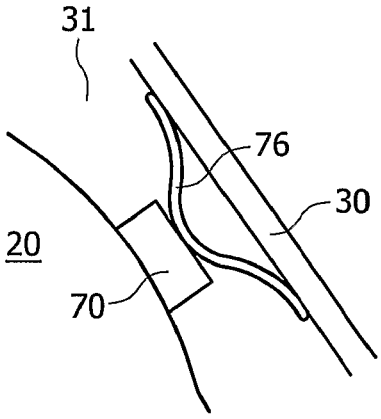
Figure 16:
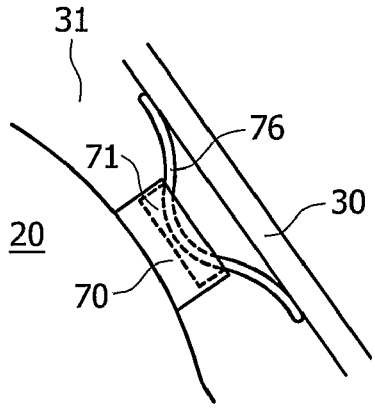

FIG. 14 diagrammatically shows a first possible alternative to a detail A of FIG. 11;

FIG. 15 diagrammatically shows a second possible alternative to the detail A of FIG. 11; and FIG. 16 diagrammatically shows a third possible alternative to the detail A of FIG. 11.

Figure 1:
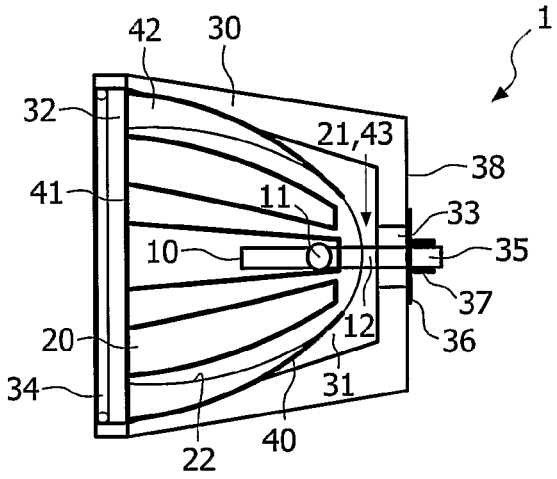
FIG. 1 is a diagrammatic side elevation of a lighting device according to a first preferred embodiment of the present invention, wherein a longitudinal section is shown of a number of elements of the lighting device.

FIG. 1 shows a lighting device 1 according to a first preferred embodiment of the present invention. In the following, this lighting device 1 will be referred to as first lighting device 1.

The first lighting device 1 comprises a lamp unit 10 for emitting light. In the example shown, the lamp unit 10 comprises a so-called ultra high performance lamp (UHP-lamp). UHP-lamps are well-known lamps. In the following, for completeness' sake, a short description of this lamp is given.

In general, a UHP-lamp comprises a lamp bulb 11 and two rod-shaped connection arms 12 extending on opposite sides of the lamp bulb 11. In FIG. 1, only these elements of the UHP-lamp are diagrammatically shown.

Inside the lamp bulb 11, a discharge space is present, which is filled with an ionizable filling. The UHP-lamp comprises two cylindrical electrodes for the purpose of ionizing the filling of the discharge space, each electrode being disposed at a respective end of the lamp bulb 11. One part of each electrode extends into the discharge space, another part extends in a connection arm. An end portion of the part of the electrode extending in the connection arm is connected to a molybdenum foil, which is connected to a lead for supplying electric current to the electrode. The connection arm accommodates both the molybdenum foil and a portion of the lead as well as a portion of the electrode.

In the first lighting device 1, the lamp unit 10 is used in combination with a reflector 20. The reflector 20 is substantially shaped like a bowl having a hole 21 in its bottom for allowing one of the connection arms 12 of the lamp unit 10 to pass through. The reflector 20 comprises a reflecting inner surface 22 so as to perform its function of reflecting light emitted by the lamp bulb 11 of the lamp unit 10. The shape of the reflecting inner surface is, for example, parabolic or elliptical.

The lamp unit 10 and the reflector 20 are accommodated inside a housing 30. The housing 30 comprises a receiving space 31, which is closed off by a transmission window 32 for transmitting the light emitted by the lamp bulb 11 of the lamp unit 10 and reflected by the reflector 20. Furthermore, a hole 33 is arranged in the housing 30 for allowing a connection arm 12 of the lamp unit 10 to pass through. The transmission window 32 is made of glass, while the rest of the housing 30 is preferably made of metal, for example aluminum.

A considerable amount of heat is generated by the lamp bulb 11 during operation of the lamp unit 10, so that the temperature of a wall of the lamp bulb may get as high as 950° C., and a temperature inside the housing 30 may get as high as 300° C. To avoid damage to the lighting device 1, it is important that heat is dissipated to the environment. According to an important aspect of the present invention, a heat sink 40 is provided, which is arranged between the reflector 20 and the housing 30 and which is thermally coupled to both the reflector 20 and the housing 30.

The heat sink 40 serves for transferring heat from the reflector 20 to the housing 30, said housing 30 then emitting the heat to the environment. It will be understood that it is important that the heat sink 40 comprises a material that is very well capable of conducting heat, for example a heat-conducting metal such as copper.

Within the scope of the present invention, the heat sink 40 may have any suitable shape, as long as the heat sink 40 is arranged between the reflector 20 and the housing 30 and is capable of transferring the heat from the reflector 20 to the housing 30 to a sufficient extent. The heat sink 40 does not necessarily need to be one integral whole, but may also comprise separate elements which are arranged between the reflector 20 and the housing 30, thereby surrounding the reflector 20 as it were. In the example shown, the heat sink 40 comprises an assembly of a top ring 41 and thin strips 42 extending from the top ring 41, which assembly fits around the reflector 20, i.e. which is substantially shaped like a bowl having a hole 43 in its bottom for a connection arm 12 of the lamp unit 10 to be passed through.

Figure 2:
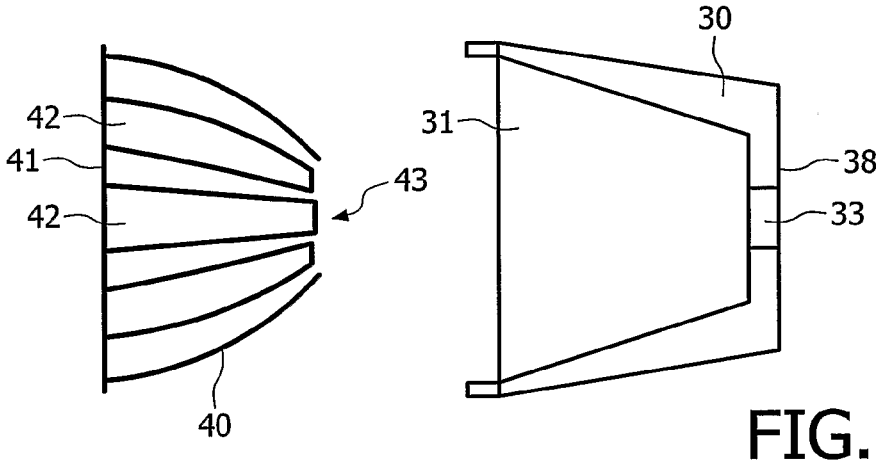
FIGS. 2 to 6 illustrate steps of an assembling process of the lighting device shown in FIG. 1.
Figure 3:
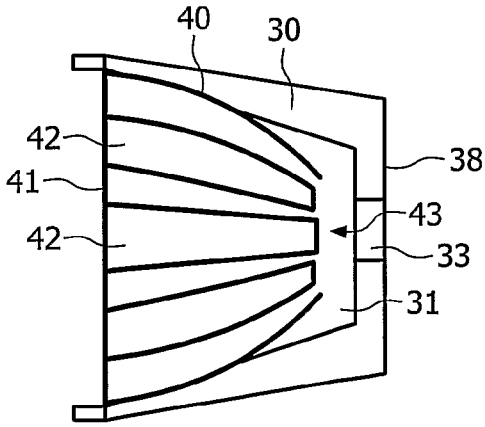

FIGS. 2 to 6 illustrate steps of an assembling process of the first lighting device 1. A first step of the assembling process comprises placing the heat sink 40 in the receiving space 31 of the housing 30. FIG. 2 shows the housing 30 and the heat sink 40, and FIG. 3 shows an assembly of the housing 30 and the heat sink 40. The heat sink 40 may be connected to the housing 30 in any suitable manner, for example by welding.

Figure 4:
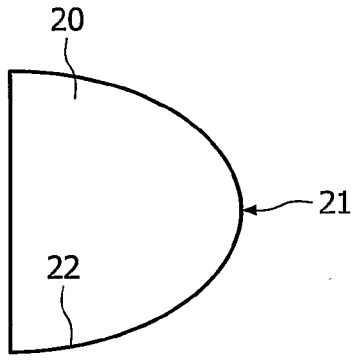
Figure 5:
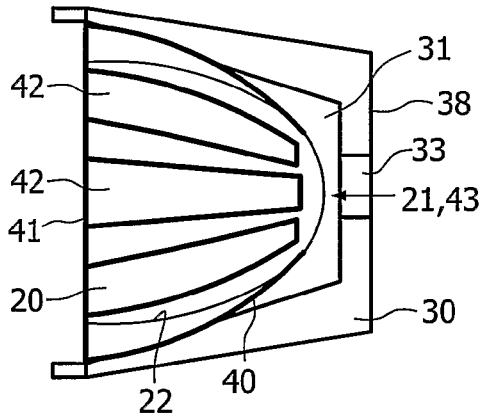

After the heat sink 40 has been placed in the receiving space 31 of the housing 30 and has been connected to the housing 30, the reflector 20 is placed in the receiving space 31 of the housing 30. FIG. 4 shows the reflector 20, and FIG. 5 an assembly of the housing 30, the heat sink 40, and the reflector 20. In the assembly, the reflector 20 is surrounded by the heat sink 40, portions of the strips 42 of the heat sink 40 being sandwiched between the reflector 20 and the housing 30. These portions transfer heat from the reflector 20 to the housing 30 during operation of the first lighting device 1.

The reflector 20 may be fixed to the housing 30 in any suitable way, for example by means of a clamping ring. Within the scope of the present invention, it is also possible that the reflector 20 is fixed to the heat sink 40, while the strips 42 of the heat sink 40 may play a role in positioning the reflector 20. It is important in such a case that the assembly of the strips 42 offers sufficient stability.

Figure 6:
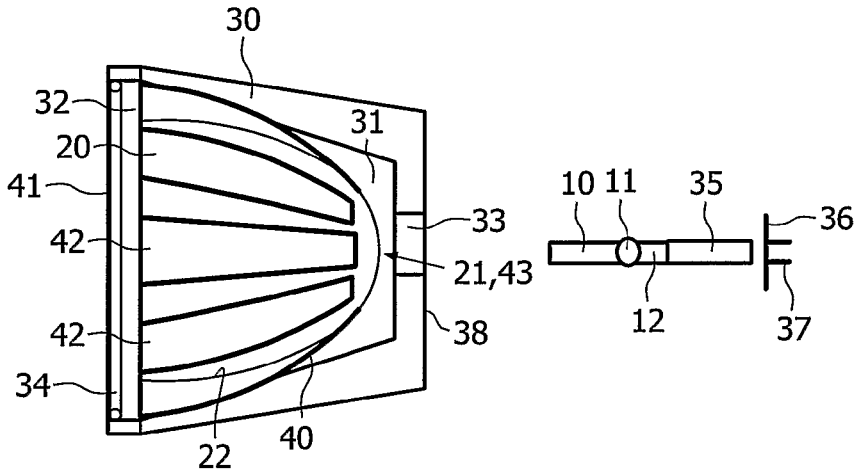

After the assembly of the housing 30, the heat sink 40, and the reflector 20 has been obtained, the receiving space 31 of the housing 30 is closed off by means of the transmission window 32. FIG. 6 shows the closed assembly of housing 30 and transmission window 32, with the heat sink 40 and the reflector 20 arranged inside this assembly. Any suitable connecting element may be used for fixing the transmission window 32 to the housing 30. In the example shown, a clamping ring 34 is applied for keeping the transmission window 32 in place with respect to the housing 30.

When the heat sink 40 and the reflector 20 are in their proper places inside the receiving space 31 of the housing 30, the lamp unit 10 is put in place. It is important that the lamp bulb 11 of the lamp unit 10 is accurately positioned with respect to the inner surface 22 of the reflector 20 so as to obtain an optimal light output. In the first lighting device 1 according to the present invention, accurate positioning of the lamp bulb 11 of the lamp unit 10 with respect to the inner surface 22 of the reflector 20 is realized by accurate positioning of the lamp bulb 11 of the lamp unit 10 with respect to the housing 30 on the one hand, and accurate positioning of the inner surface 22 of the reflector 20 with respect to the housing 30 on the other hand.

In the example shown, a metal cap 35 and a positioning plate 36 having a hole and an associated receiving unit 37 for receiving the metal cap 35 are used for positioning the lamp unit 10 with respect to the housing 30. The metal cap 35 and the positioning plate 36 also play a role in fixing the lamp unit 10 to the housing 30 once the lamp unit 10 is in the proper position with respect to the housing 30. The metal cap 35 and the positioning plate 36 are shown in FIG. 6. The lamp unit 10 is also shown in FIG. 6, with the metal cap 35 arranged on an end portion of a positioning arm 12.

The process of putting the lamp unit 10 in place comprises a number of steps. First, the metal cap 35 is arranged on an end portion of a positioning arm 12 of the lamp unit 10. Subsequently, the assembly of lamp unit 10 and metal cap 35 is put approximately in place in that a free connection arm 12, the lamp bulb 11, and a portion of the other connection arm 12 are moved through the holes 33, 43, 21 in the housing 30, the heat sink 40, and the reflector 20, respectively. When the lamp unit 10 is roughly in place, the positioning plate 36 is placed against a portion of an outer surface 38 of the housing 30, in particular a portion of the outer surface 38 surrounding the hole 33. In the process, a portion of the metal cap 35 is received in the receiving unit 37. In a simple embodiment, the receiving unit 37 is shaped as a sleeve which is capable of closely surrounding the metal cap 35.

As has already been noted, it is important that the lamp unit 10 is accurately positioned with respect to the housing 30, so that the lamp bulb 11 of the lamp unit 10 is accurately positioned with respect to the inner surface 22 of the reflector 20. An adjustment of the position of the lamp unit 10 in the longitudinal direction is realized by a displacement of the metal cap 35 with respect to the receiving unit 37 of the positioning plate 36 in the same direction. An adjustment of the position of the lamp unit 10 in a direction perpendicular to the longitudinal direction is realized by a displacement of the positioning plate 36 with respect to the housing 30 in the same direction.

Furthermore, it is important that a longitudinal axis of the lamp unit 10 coincides with an axis of symmetry of the reflector 20. Therefore, the receiving unit 37 is adapted so as to align the metal cap 35 in the longitudinal direction when the positioning plate 36 is placed against the outer surface 38 of the housing 30. A proper alignment of the lamp unit 10 is obtained in this way. When the lamp unit 10 is in the desired position, the metal cap 35 is fixed to the positioning plate 36, and the positioning plate 36 is fixed to the housing 30, for example by means of welding.

Figure 7:
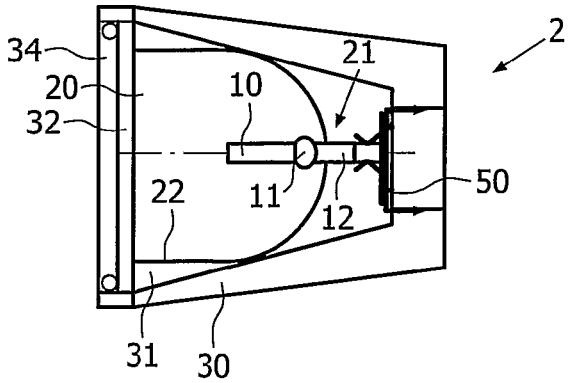
FIG. 7 is a diagrammatic longitudinal sectional view of a lighting device according to a second preferred embodiment of the present invention.

FIG. 7 shows a lighting device 2 according to a second preferred embodiment of the present invention. In the following, this lighting device 2 will be referred to as second lighting device 2.

Figure 8:
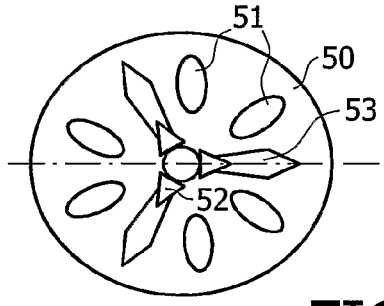
FIG. 8 is a diagrammatic plan view of a base plate which is part of the lighting device shown in FIG. 7.

Like the first lighting device 1, the second lighting device 2 comprises a lamp unit 10, a reflector 20, and a housing 30, the lamp unit 10 and the reflector 20 being accommodated in a receiving space 31 of the housing 30 which is closed off by a transmission window 32. A difference between the second lighting unit 2 and the first lighting unit 1 relates to the way in which the lamp unit 10 is connected to the housing 30. In the second lighting unit 2, a base plate 50 is applied for establishing the connection between the lamp unit 10 and the housing 30. A plan view of the base plate 50 is shown in FIG. 8. The base plate 50 is connected to the housing 30, and an end of a connection arm 12 of the lamp unit 10 is connected to the base plate 50.

The connection between the base plate 50 and the housing 30 may be established in any suitable way. In the example shown, the base plate 50 is not positioned against the housing 30, but is arranged at a distance from the housing 30. This arrangement of the base plate 50 is related to the fact that cooling holes 51 are arranged in the base plate 50 in this example. During operation of the lamp unit 10, heat emitted by the end of the connection arm 12 of the lamp unit 10, which end is connected to the base plate 50, is removed through the cooling holes 51.

The connection between the end of the connection arm 12 of the lamp unit 10 and the base plate 50 may also be established in any suitable way. Preferably, the base plate 50 comprises connection pieces 52 which are formed as pieces which are partly cut out and bent from the base plate 50. The base plate 50 shown in FIG. 8 comprises three connection pieces 52, and consequently comprises three elongated holes 53, wherein a base of each connection piece 52 is attached to a base of the associated hole 53. The three connection pieces 52 are positioned on the periphery of a circle so as to be capable of closely surrounding the end of the connection arm 12 of the lamp unit 10.

Figure 9:
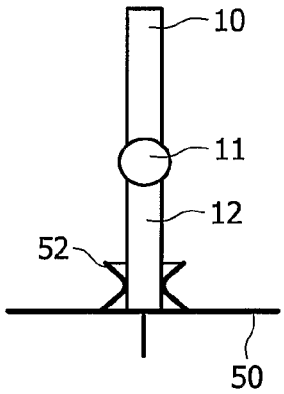
FIG. 9 is a diagrammatic longitudinal sectional view of an assembly of a lamp unit and the base plate shown in FIG. 8.

FIG. 9 a side elevation of a first possibility of the connection pieces 52. According to this possibility, the connection pieces 52 are bent in a direction towards each other approximately halfway their length. The mutual distances between the connection pieces 52 are chosen such that, when the end of the connection arm 12 of the lamp unit 10 is inserted between the connection pieces 52, the end is contacted by the bent portions of the connection pieces 52. It is possible to rely on the clamping force exerted on the end of the connection arm 12 of the lamp unit 10 by the combination of the connection pieces 52, but it is also possible in addition to secure the connection between the end and the connection pieces 52, for example by using cement that is applied between the end and the connection pieces 52.

Figure 10:
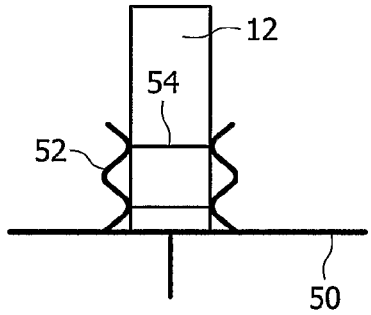
FIG. 10 is a diagrammatic longitudinal sectional view of an alternative to the assembly shown in FIG. 9.

FIG. 10 is a side elevation of a second possibility of the connection pieces 52. According to this possibility, the connection pieces 52 comprise two inwardly bent portions. When the end of the connection arm 12 of the lamp unit 10 is inserted between the connection pieces 52, the connection between the end and the connection pieces 52 is secured by means of heat-resistant wires 54 pulled around the connection pieces 52 at the bent portions. It is also possible that other tightening means, such as clamping springs, are used instead of wires 54.

It will be understood that the number of bent portions of the connection pieces 52 is not essential. Furthermore, it will be understood that it is possible to take extra measures for connecting the end of the connection arm 12 of the lamp unit 10 to the base plate 50. For example, the end of the connection arm 12 of the lamp unit 10 may be provided with at least one groove, such that the at least one bent portion of the connection pieces 52 can be snapped into this groove, whereby a more secure fixation is obtained.

Figure 12:
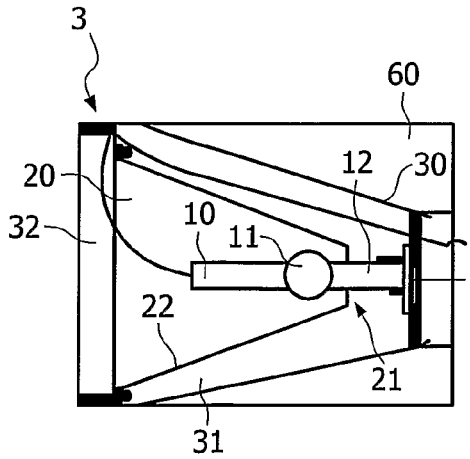
FIG. 12 is a diagrammatic longitudinal sectional view of the lighting device shown in FIG. 11.
Figure 13:
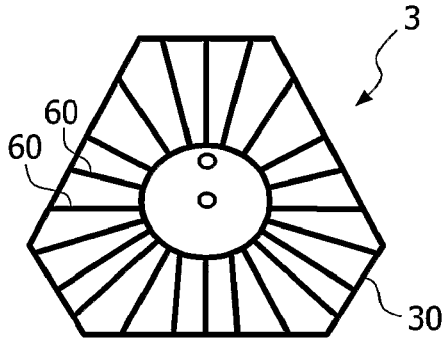
FIG. 13 is a diagrammatic rear view of the lighting device shown in FIG. 11.

FIGS. 11 to 13 show a lighting device 3 according to a third preferred embodiment of the present invention. In the following, this lighting device 3 will be referred to as third lighting device 3.

In the third lighting device 3, the reflector 20 is clamped in by the housing 30. Another characteristic feature of the third lighting device 3 is that the shape of the circumference of the housing 30 differs from the shape of the circumference of the reflector 20. In the example shown, the circumference of the reflector 20 is circular, and the circumference of the housing 30 is hexagonal, wherein three sides 39 are designed to exert clamping forces on the reflector 20. These three sides 39 are provided in a triangular arrangement, i.e. the relation between these sides 39 is similar to the relation between sides of a triangle.

The process of positioning the reflector 20 in the housing 30 is facilitated by the fact that the reflector 20 is clamped in by the housing 30. Once the reflector 20 has been inserted into the receiving space 31 of the housing 30, the reflector 20 is fixed with respect to the housing 30 without any need for additional measures. Since the circumferences of the housing 30 and the reflector 20 have different shapes, there is more room for adjustment of the position of the reflector 20 inside the housing 30 than if the circumferences were to have similar shapes.

Preferably, the three sides 39 of the housing 30 are resilient, enhancing the clamping action of the housing 30. A further advantageous consequence is that deviations of the dimensions of the reflector 20 can be compensated for by a resilient action of at least one of the sides 39. A possible bulging of one of the sides 39 is diagrammatically depicted in FIG. 11 by means of a dashed line.

FIGS. 12 and 13 show that the housing 30 may be set with cooling fins 60 or other projections. The cooling fins 60 enlarge a heat dissipation surface of the housing 30. As a result, the heat dissipation from the housing 30 to the environment is enhanced during operation of the third lighting device 3.

FIGS. 14 and 15 serve to illustrate possible arrangements in which a rotation of the reflector 20 about its longitudinal axis is prevented once the reflector 20 has been placed inside the housing 30. In general, these arrangements involve an engagement of a projection and an engaging member, wherein the projection is arranged on one of the reflector 20 and the housing 30, and wherein the engaging member is arranged on the other one of the reflector 20 and the housing 30. It will be understood that the number of combinations of a projection and an engaging member is not essential, and that it is preferred to have at least two such combinations.

According to the possibility illustrated by FIG. 14, three projections 70 are arranged on the reflector 20, while a row of saw teeth 75 is arranged on the housing 30, more in particular the sides 39 intended to exert a clamping force on the reflector 20. The reflector 20 is inserted into the housing 30 with the projections 70 in a free space between the reflector 20 and the housing 30. Subsequently, the reflector 20 is rotated with respect to the housing 30 about its longitudinal axis such that the projections 70 come into engagement with the saw teeth 75 and are locked by the saw teeth 75. In the process, the projections 70 first run up a beveled side of the saw teeth 75, after which the projections 70 get locked against an upright side of the projections 70.

According to the possibility illustrated by FIG. 15, three projections 70 are arranged on the reflector 20, while three leaf springs 76 are arranged on the housing 30, more in particular the sides 39 intended to exert a clamping force on the reflector 20. The reflector 20 is inserted into the housing 30 with the projections 70 in a free space between the reflector 20 and the housing 30. Subsequently, the reflector 20 is rotated with respect to the housing 30 about its longitudinal axis such that the projections 70 come into contact with the leaf springs 76. In the process, the leaf springs 76 are compressed by the projections 70 and exert a compression force on the projections, as the leaf springs 76 are inclined to spring outwards again. The compression forces retain the reflector 20 the housing 30, while rotation of the reflector 20 about its longitudinal axis is prevented.

In order to prevent also a displacement of the reflector 20 with respect to the housing 30 in the longitudinal direction, it is possible to arrange a recess 71 in the projections 70, so that a portion of the leaf springs 76 gets locked inside the recess 71 of the projections 70 when the reflector 20 is being rotated with respect to the housing 30 for the purpose of bringing the projections 70 into contact with the leaf springs 76. A combination of a projection 70 having a recess 71 and a leaf spring 76 locked inside the recess 71 is illustrated by FIG. 16.

The lighting devices 1, 2, 3 described above are suitable for various purposes. For example, the lighting devices 1, 2, 3 may be applied in a projector, in a rear projection television, or in an automobile.

It will be clear to those skilled in the art that the scope of the present invention is not limited to the examples discussed above, but that several amendments and modifications thereof are possible without deviating from the scope of the present invention as defined in the attached claims.

Within the scope of the present invention, various other embodiments of a lighting device are feasible in which specific features of two or three of the above-described embodiments are combined. For example, one embodiment may be based on the second lighting device 2 or the third lighting device 3 while additionally comprising a heat sink 40 as shown in relation to the first lighting device 1. Another embodiment may be based on the first lighting device 1 or the second lighting device 2 while additionally comprising cooling? fins 60 as shown in relation to the third lighting device 3.

In the foregoing, a lighting device 1, 2, 3 was disclosed comprising a lamp unit 10 for emitting light, a reflector 20 for reflecting the emitted light, and a housing 30 for accommodating both the lamp unit 10 and the reflector 20. Much heat is generated by the lamp unit 10 during operation of the device 1, 2, 3, if the lamp unit 10 comprises a lamp operating at a high power level, such as an ultra high performance lamp, which heat needs to be dissipated to the environment of the lighting device 1, 2, 3.

It is disclosed how the lighting device can be provided with a heat sink 40 arranged between the reflector 20 and the housing 30, thermally coupled to both the reflector 20 and the housing 30, in order to enhance the heat dissipation. In one possible embodiment, the heat sink 40 comprises an assembly of a ring 41 and metal strips 42 extending from the ring 41, which assembly surrounds the reflector 20.

The invention claimed is:

1. A lighting device, comprising:

a lamp unit for emitting light;

a reflector for reflecting light emitted by the lamp unit, substantially shaped like a bowl having a hole in its bottom for allowing the lamp unit to pass through;

a housing for accommodating both the lamp unit and the reflector; and a heat sink arranged between the reflector and the housing for transferring heat from the reflector to the housing during operation of the lighting device, which heat sink is thermally coupled to both the reflector and the housing, the heat sink comprising an assembly of a top ring and curved strips extending from the top ring, wherein the curved strips form a thin, flat layer on the housing between the reflector and the housing, which assembly is substantially shaped like a bowl having a hole in its bottom for allowing the lamp unit to pass through and which assembly surrounds the reflector.

2. The lighting device according to claim 1, wherein the heat sink is a heat-conducting metal.

3. A lighting device comprising:

a lamp unit for emitting light, comprising a lamp bulb and two rod-shaped connection arms extending on opposite sides of the lamp bulb;

a reflector for reflecting light emitted by the lamp unit, substantially shaped like a bowl having a hole in its bottom for allowing a connection arm of the lamp unit to pass through;

a housing for accommodating both the lamp unit and the reflector; and a base plate connected to the housing, wherein an end of the connection arm of the lamp unit extending through the hole in the reflector is connected to the base plate, wherein the base plate comprises at least one hole for allowing heat emitted by the end of the connection arm connected to the base plate to pass through, and wherein the connection between the end of the connection arm of the lamp unit and the base plate is established through an engagement of the end of the connection arm with at least one connection piece that is partly cut out and bent from the base plate.

4. The lighting device according to claim 3, wherein the end of the connection arm of the lamp unit and the at least one connection piece are connected through tightening means, wherein the connection piece is positioned against the connection arm, and wherein the tightening means are arranged around both the connection arm and the connection piece, pulling the connection piece against the connection arm.

5. A lighting comprising:

a lamp unit for emitting light;

a reflector for reflecting light emitted by the lamp unit, substantially shaped like a bowl having a hole in its bottom for allowing the lamp unit to pass through; and a housing for accommodating both the lamp unit and the reflector, wherein the reflector is clamped in by the housing and the shape of a circumference of the housing is different from the shape of a circumference of the reflector, and wherein the reflector is fixed with respect to the housing by means of at least one projection held by an engaging member engaging the projection, wherein the at least one projection extends from one of the reflector and the housing, and wherein the engaging member is arranged on the respective other one of the reflector and the housing.

6. The lighting device according to claim 5, wherein the shape of the circumference of the reflector is round, and wherein elements of the housing intended to exert a clamping force on the reflector are arranged in a triangular relation.

7. The lighting device according to claim 6, wherein the elements of the housing intended to exert a clamping force on the reflector are resilient.

8. The lighting device according to claim 5, wherein the engaging member is a row of saw teeth.

9. The lighting device according to claim 5, wherein the engaging member is an element which springs outwards when it is compressed.

* * * * *